US006505393B2

(12) United States Patent
Stoewer et al.

(10) Patent No.: US 6,505,393 B2
(45) Date of Patent: Jan. 14, 2003

(54) TWO-PART RIVETING APPARATUS AND METHOD FOR RIVETING BARREL-SHAPED COMPONENTS SUCH AS AIRCRAFT FUSELAGE COMPONENTS

(75) Inventors: Udo Stoewer, Bremen (DE); Bernd Koehler, Neu Wulmstorf (DE); Norbert Kosuch, Rosengarten-Sottorf (DE)

(73) Assignee: Airbus Deutschland GmbH, Hamburg (DE)

( * ) Notice: Subject to any disclaimer, the term of this patent is extended or adjusted under 35 U.S.C. 154(b) by 10 days.

(21) Appl. No.: 09/905,617

(22) Filed: Jul. 13, 2001

(65) Prior Publication Data

US 2002/0007548 A1 Jan. 24, 2002

Related U.S. Application Data

(63) Continuation-in-part of application No. 09/366,036, filed on Aug. 2, 1999, now abandoned.

(30) Foreign Application Priority Data

Jul. 31, 1998 (DE) ..... 198 34 702

(51) Int. Cl.[7] ..... B21J 15/02
(52) U.S. Cl. ..... 29/525.06; 29/348; 29/243.53; 29/715
(58) Field of Search ..... 29/243.53, 33 K, 29/34 B, 525.06, 715; 227/52

(56) References Cited

U.S. PATENT DOCUMENTS

| | | | |
|---|---|---|---|
| 2,383,225 | A | 8/1945 | Sorensen et al. |
| 3,113,373 | A | 12/1963 | Guyer, Jr. |
| 3,485,306 | A | 12/1969 | Gulley |
| 4,299,871 | A | 11/1981 | Forsch |
| 4,548,345 | A | 10/1985 | Puritz et al. |
| 4,637,761 | A | 1/1987 | Murray et al. |

(List continued on next page.)

FOREIGN PATENT DOCUMENTS

| | | |
|---|---|---|
| DE | 3232093 | 3/1984 |
| DE | 3438584 | 5/1985 |
| DE | 3535761 | 3/1987 |
| DE | 3715927 | 12/1988 |

OTHER PUBLICATIONS

Brochure entitled "ARAS Survey of the complete range of ARAS Systems in Aircraft Production", AFS ARAS Systems, Bellevue, WA, pp. 1 to 7.
FASTEC '85; Conference Proceedings, Oct. 8–11, 1985, Atlanta, Georgia, by Lennart Gidlund, pp. 1 to 14.

*Primary Examiner*—Gregory M. Vidovich
*Assistant Examiner*—Steven A Blount
(74) *Attorney, Agent, or Firm*—W. F. Fasse; W. G. Fasse

(57) ABSTRACT

An apparatus for riveting shell components to form a barrel-shaped structure such as an aircraft fuselage includes an outer part and an inner part that operate coordinated with each other under computer control. The outer apparatus part includes a riveting machine system movably carried on an annular machine guide that is supported on a stand that is movable in a length-wise X-direction. The inner apparatus part includes a multi-axis riveting robot mounted on a mounting frame that is movable along the X-direction. Instead of moving the inner and outer apparatus parts in the X-direction, it is alternatively possible to move the fuselage while keeping the apparatus parts stationary. A computer control unit provides control signals to achieve a coordinated and concurrent positioning of the inner and outer apparatus parts, and to carry out a coordinated sequence of riveting steps. Rivets can be automatically fastened even at difficult to access locations, while avoiding structural obstacles inside the aircraft fuselage. The apparatus parts are supported independently of the fuselage on the floor of the assembly hall.

27 Claims, 8 Drawing Sheets

U.S. PATENT DOCUMENTS

| | | | | |
|---|---|---|---|---|
| 4,662,556 | A | | 5/1987 | Gidlund |
| 4,762,261 | A | | 8/1988 | Hawly |
| 4,821,408 | A | | 4/1989 | Speller, Sr. et al. |
| 4,854,491 | A | | 8/1989 | Stoewer |
| 4,858,301 | A | * | 8/1989 | Galarowic |
| 4,885,836 | A | | 12/1989 | Bonomi et al. |
| 4,967,947 | A | | 11/1990 | Sarh |
| 5,033,014 | A | | 7/1991 | Carver et al. |
| 5,560,102 | A | | 10/1996 | Micale et al. |
| 5,586,391 | A | | 12/1996 | Micale |
| 5,615,483 | A | | 4/1997 | Micale et al. |
| 5,694,690 | A | | 12/1997 | Micale |
| 5,896,637 | A | | 4/1999 | Sarh |
| 6,029,352 | A | | 2/2000 | Nelson |
| 6,073,326 | A | | 6/2000 | Banks et al. |
| 6,088,897 | A | | 7/2000 | Banks et al. |
| 6,098,260 | A | | 8/2000 | Sarh |
| 6,237,210 | B1 | * | 5/2001 | Stoewer et al. |

* cited by examiner

TWO-PART RIVETING APPARATUS AND METHOD FOR RIVETING BARREL-SHAPED COMPONENTS SUCH AS AIRCRAFT FUSELAGE COMPONENTS

CROSS-REFERENCE TO RELATED APPLICATION

This application is a continuation-in-part of our prior U.S. application Ser. No. 09/366,036, filed on Aug. 2, 1999, abandoned the benefit of which is claimed under 35 U.S.C. §120.

PRIORITY CLAIM

This application is partly based on and claims the priority under 35 U.S.C. §119 of German Patent Application 198 34 702.2, filed on Jul. 31, 1998, through prior U.S. application Ser. No. 09/366,036, filed on Aug. 2, 1999. The entire disclosures of the above identified German Patent Application and prior U.S. Application are incorporated herein by reference.

FIELD OF THE INVENTION

The invention relates to a riveting apparatus for riveting large surface area components having a curved contour to fabricate a barrel-shaped structure such as an aircraft fuselage.

BACKGROUND INFORMATION

Automatic and semi-automatic robotic riveting apparatus are known for connecting large surface area components using rivets. Such known apparatus are suitable for the fabrication of aircraft fuselage shells and other barrel-shaped or cylindrical structures that are fabricated from a plurality of individual curved components having large surface areas. For example, German Patent 35 35 761 and corresponding U.S. Pat. No. 4,762,261 (Hawly et al.) disclose an automatic robotic riveting apparatus by means of which curved workpieces having large surface areas can be rivet-fastened or the like. The disclosure of U.S. Pat. No. 4,762,261 is incorporated herein by reference.

The known riveting apparatus comprises a machine frame in which a workpiece is mounted so as to be movable along the X-axis. Two riveting systems or tool carriers that cooperate with each other for carrying out the riveting process are respectively arranged on a riveting positioning frame that is movable in the Z-direction, while the riveting systems or tool carriers are selectively positionable in the Y-direction and tiltable about the X-axis. One of the riveting systems comprises a riveting device including all the necessary tools for boring rivet holes, feeding and sinking rivets, and counterholding during a rivet closing process. The other riveting system comprises a pressure sleeve, a rivet snap or anvil, and a counterholder for forming the closing head of each respective rivet. In order to carry out a riveting process, the two riveting systems are driven and positioned to the corresponding rivet location in a computer aided or computer guided manner, and then the various steps of the riveting process are carried out and coordinated also in a computer aided manner.

It is a disadvantage of this known automatic riveting robot that it can only be used in a limited field of applications due to its high structural mass. A further disadvantage is that only certain rivet connections can be produced by this conventional automatic riveting robot, because the riveting systems are not individually movable in all spacial axes.

Further disadvantages result because the workpieces, for example aircraft fuselage shell components, must be slidingly pushed or advanced in the X-axis direction during the riveting process, which requires a rather heavy and complicated holding jig or support frame structure for precisely positioning the large workpieces.

Another riveting apparatus suitable for forming a rivet connection for large surface area components is disclosed in German Patent 37 15 927 and corresponding U.S. Pat. No. 4,854,491 (Stoewer). The disclosure of U.S. Pat. No. 4,854,491 is incorporated herein by reference. This known riveting apparatus comprises two mechanically separated apparatus parts, namely one respective apparatus part on the primary or set head side of the rivet and another apparatus part on the closing head side of the rivet. Each one of these apparatus parts respectively essentially comprises a machine guide arrangement carrying a tool unit. A computer is provided to control the positioning as well as the working steps carried out in the process of forming and preparing the rivet holes and then inserting rivets into the holes, as well as closing the rivets.

In this known riveting apparatus, for carrying out the riveting operation, machine guide arrangements are provided respectively on both sides of the components or workpieces that are to be rivet-connected to each other and that are held in a supporting frame. The machine guide arrangements and respective apparatus parts on the two sides of the workpieces are necessary to allow the respective tool units to be guided to and positioned at the respective riveting locations. However, in practice, it is very difficult and complicated or even impossible to properly arrange the respective machine guide arrangements for forming rivets at particular individual rivet locations, especially in the area within an aircraft fuselage for forming a lengthwise or transverse seam of the fuselage. This is especially true because the interior of the fuselage shell comprises frames, stringers, spars, ribs and struts and the like, which represent obstacles or obstructions around which the machine guide arrangement and the respective tool units must be moved, and which in some cases completely block access to the required rivet locations.

U.S. Pat. No. 6,098,260 (Sarh) discloses a system for riveting radial or circumferential joints of an aircraft fuselage. In this known system, an outer riveting apparatus includes crescent-shaped base members that are supported on the fuselage itself and are directly secured to the fuselage by suction cups or the like, and a first riveting device that is movably supported on the crescent-shaped base members, so as to ride along the base members while fastening rivets along a circumferential joint of the fuselage. Further in the known system, an inner riveting apparatus includes a base unit or base plate that is mounted on the floor beams of the interior of the fuselage itself, and a second riveting device that cooperates from inside the fuselage with the first riveting device outside the fuselage to fasten the rivets along the respective circumferential joint.

Thus, both the inner apparatus and the outer apparatus of the known system of U.S. Pat. No. 6,098,260 are mounted on and fully supported by the fuselage that is being assembled. This limits the mobility of the apparatus relative to the fuselage. Namely, the supporting base of the outer apparatus itself is not mobile relative to the fuselage. Instead, a crane is necessary to lift the outer apparatus and move it from one circumferential fuselage joint to the next, and therefore the system is not suited to riveting longitudinal joints. Moreover, the known arrangement must have its crescent-shape adapted exactly to the contour of the particular type of fuselage being assembled, and presents the danger that the weight of the two apparatus will deform or misalign the aircraft sections being joined. Other known systems in which the inner and/or outer riveting apparatus are mounted and supported on the fuselage itself suffer the same disadvantages.

SUMMARY OF THE INVENTION

In view of the above it is an object of the invention to provide a two-part riveting apparatus for riveting barrel-shaped components, which makes it possible to carry out a flexible or adaptable positioning of the tool units on or relative to the respective workpiece in longitudinal and circumferential directions, and especially at previously inaccessible or difficult to access rivet locations which are at least partially obstructed due to strengthening components or equipment mounting components, such as frames, stringers, spars, ribs, struts or the like in the interiors of a barrel-shaped structure. Moreover, it is an object of the invention to provide such an apparatus that is fully independent of the workpiece being assembled, i.e. is not supported or mounted on the workpiece, but instead is supported and mounted independently from the workpiece. Another object of the invention is to provide an apparatus that can fully automatically carry out the riveting operation with great precision in a computer controller manner. The invention further aims to avoid or overcome the disadvantages of the prior art, and to achieve additional advantages, as apparent from the present specification.

The above objects have been achieved according to the invention in a joining apparatus and particularly a riveting apparatus suitable for riveting together curved large surface area components to form a manufactured product such as an aircraft fuselage, including a barrel-shaped structure and possibly further including a floor structure or the like mounted inside the barrel-shaped structure. According to the invention, the riveting apparatus includes an outer apparatus part arranged externally around the barrel-shaped structure, an internal apparatus part reaching inside the barrel-shaped structure, and a control unit for controlling the operation of the two apparatus parts for carrying out the riveting process.

The outer part of the apparatus comprises an annular machine guide arrangement that is arranged externally encircling the barrel-shaped structure and that is relatively movable along the lengthwise X-axis of the barrel-shaped structure. Particularly, either the annular machine guide arrangement or the barrel-shaped structure is movable in the X-direction relative to the other. The outer part further comprises at least one riveting machine system including the necessary tools or devices for producing and preparing rivet holes, supplying and inserting rivets into the rivet holes, and then completing the riveting process. The riveting machine system is movably arranged on the machine guide arrangement so as to be selectively movable to preselected rivet locations. These rivet locations are defined by stored data or input data of the control unit so that the rivet machine system is moved to the respective rivet locations in succession in a computer aided or computer controlled manner. Instead of the riveting machine, the outer part may include a welding machine or an adhesive bonding machine or other types of joining machines known in the art.

The inner part of the riveting apparatus comprises a mounting frame that is relatively movable along the lengthwise X-axis of the barrel-shaped structure, as well as a multi-axis movable controlled riveting robot arranged on the mounting frame. The riveting robot includes a working head with the necessary tools for carrying out one side of the riveting operation (or other joining operation such as a welding operation, adhesive bonding operation, or the like). The mounting frame and the riveting robot cooperate with one another and are moved in a computer aided or computer controlled manner so as to move the working head of the riveting robot selectively to the respective working positions inside the barrel-shaped structure corresponding to the rivet locations defined on the outside of the barrel-shaped structure. Specifically, the control unit provides the necessary control signals to the outer part of the apparatus and the inner part of the apparatus, so as to ensure the coordinated and aligned positioning of the outer and inner parts of the apparatus respectively at a selected rivet location.

In the present apparatus, the inner part and the outer part are each supported independently of the manufactured product including the barrel-shaped structure being assembled, and are independently movable and arrangeable under a computer aided guidance relative to the manufactured product. Either the inner part and the outer part of the apparatus, or the manufactured product itself, may be movable relative to the other in the longitudinal X-direction. In this manner, each individual part of the apparatus, i.e. the outer part and the inner part, can be moved as necessary and the tools can be oriented and positioned with the required degrees of freedom of motion so as to efficiently move or reach around any obstructions and thereby reach difficult to access rivet locations in a fully automatic manner. This makes it possible to achieve an economically advantageous riveted seam fabrication of curved, large surface area components to form a barrel-shaped structure such as an aircraft fuselage.

The above objects have further been achieved according to the invention in a method of joining shell components to form a manufactured product including a barrel-shaped structure. In a first embodiment of the method, the inner and outer apparatus parts are movable relative to an assembly hall or shop in which the assembly is carried out, while the manufactured product remains stationary relative to the assembly hall or shop. In a second embodiment of the method, the manufactured product is moved relative to the shop, while at least the outer apparatus part and preferably also the inner apparatus part remain stationary relative to the shop. In both embodiments, the motion, alignment and positioning of the barrel-shaped structure and/or the apparatus parts are preferably numerically controlled, e.g. by an automated, computer control executing a pre-established program.

In the first embodiment of the method, the barrel-shaped structure that is being assembled is supported on the shop floor by adjustable supports that adjust the height, orientation and alignment of the structure, while the outer apparatus part is movable along rails on the shop floor, and the inner apparatus part is either standing on the shop floor or also movable on rails on the floor. Starting from a first assembled section, further sections are joined onto the structure as follows. Curved shell components for the next section are moved into position, adjusted and supported in a respective assembly station. The shell components are preferably tacked or held together, and then the circumferential joint adjoining the structure is riveted by the cooperating outer and inner riveting tools, whereby the outer and inner apparatus parts have moved to the appropriate location in the longitudinal X-direction to achieve the riveting of this joint. Then, the structure being assembled remains stationary, and the outer apparatus part moves along the X-direction (while the robot of the inner apparatus part correspondingly moves the inner riveting tool) to rivet the respective longitudinal joints between adjoining ones of the shell components to finish joining this section.

While the structure being assembled still remains stationary, the shell components for the next section are moved into position, adjusted and supported in a next respective assembly station. These shell components are tacked or held together, and then they are joined to the previously riveted section by the inner and outer riveting tools cooperating to rivet the circumferential joint. Next, the outer apparatus part moves along the X-direction (while the robot of the inner apparatus part correspondingly moves the inner riveting tool) to rivet the respective longitudinal joints between adjoining ones of the shell components to finish joining this newest section.

In this manner, the barrel-shaped structure remains stationary but "grows" along the x-direction by the rivet-joining of successive sections. To add each section to the structure, the shell components forming the new section are first positioned and tacked, then joined to the structure along the circumferential joint, and finally the longitudinal joints between the shell components are riveted to finish this respective section. Throughout this process, the structure remains stationary, while the inner and outer apparatus parts move along the shop floor as necessary in the direction of "growth" of the structure in the X-direction, and the inner and outer riveting tools additionally move in the circumferential direction as necessary to carry out the riveting.

In the second embodiment, the barrel-shaped structure being assembled is supported and adjusted on movable carriages or pallets, for example that are movable along rails on the shop floor, while the outer and inner machine parts remain fixed relative to the shop floor. The shell components for each respective successive section are moved into place, positioned and held or tacked in a defined assembly station. The apparatus rivets the circumferential joint, and then the structure and next section are moved (by means of the moving carriages or pallets) through the outer apparatus part while it carries out riveting along the longitudinal joints. The joining steps are similar to the first embodiment, except that here the structure is moved relative to the shop floor and the riveting apparatus, while the apparatus remains stationary relative to the shop floor (this means that the supporting frames of the apparatus are stationary while of course the riveting tools are moved relative to the supporting frames as necessary along the joints to be riveted, e.g. in the circumferential direction).

BRIEF DESCRIPTION OF THE DRAWINGS

In order that the invention may be clearly understood it will now be described in connection with example embodiments, with reference to the accompanying drawings, wherein.

DETAILED DESCRIPTION OF PREFERRED EXAMPLE EMBODIMENTS AND OF THE BEST MODE OF THE INVENTION

Figure 1:
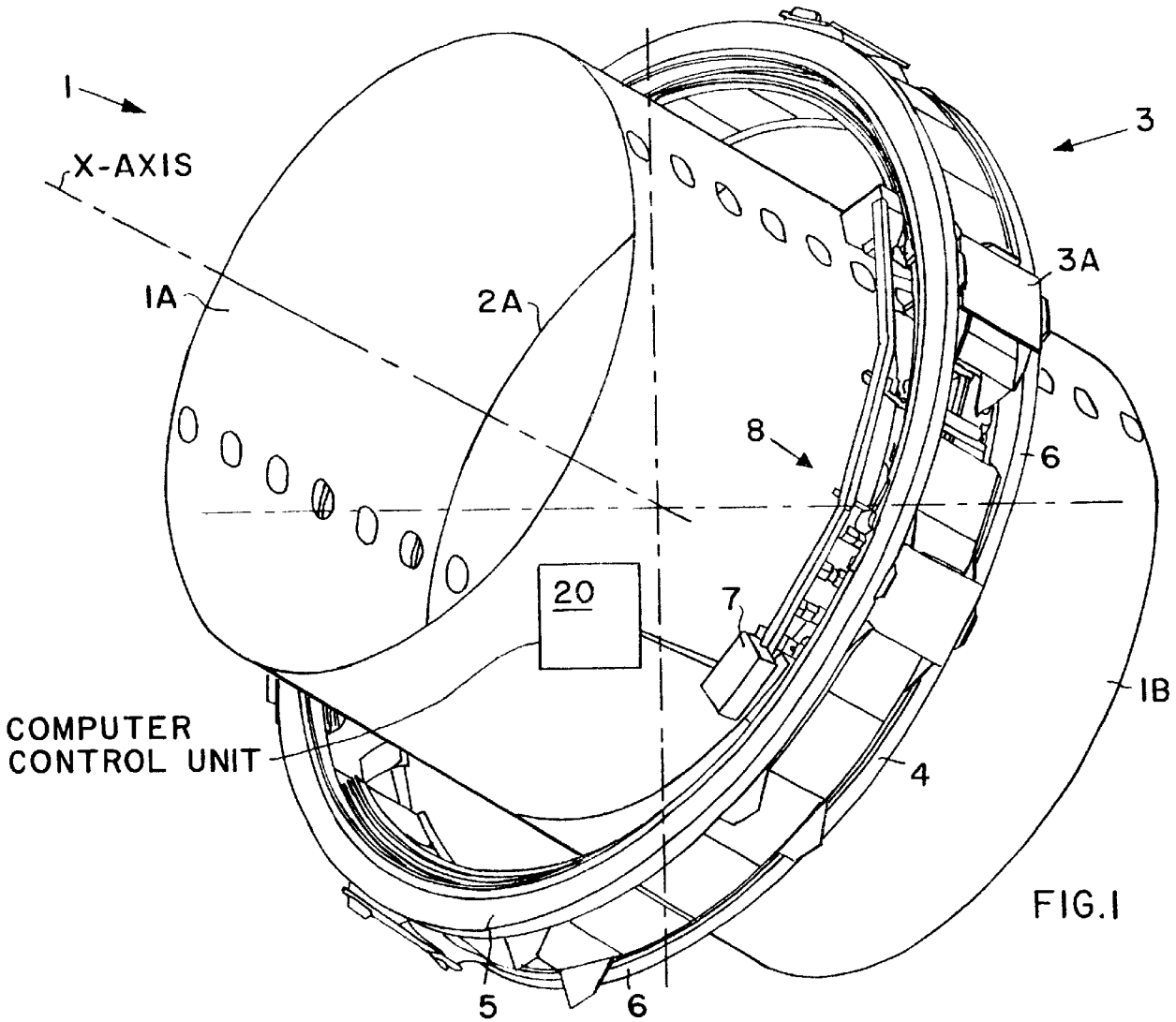
FIG. 1 is a schematic perspective view of the outer part of a riveting apparatus according to the invention including an external riveting machine system for producing a riveted transverse seam and a part of a riveted lengthwise seam of a fuselage section of an aircraft.

FIG. 1 shows two aircraft fuselage sections 1A and 1B as respective parts of an aircraft fuselage 1. The two fuselage sections 1A and 1B are to be joined to each other typically along a transverse or circumferential seam or joint 2A, where the joining is carried out by a great number of rivets respectively secured in corresponding rivet holes. Any known type of rivet or rivet-like fastener can be fastened along the seam using the inventive apparatus as will now be described. Also, instead of the riveting device forming a riveted joint, the present apparatus could include any other type of joining device such as a welding device or an adhesive bonding device to form respective different types of joints. The present preferred embodiment described herein uses a riveting device to form riveted joints. An automatic riveting apparatus is advantageously used for fabricating the riveted joints during the assembly of the aircraft fuselage 1, because only an automatic method and apparatus for carrying out the riveting can achieve an economically viable fabrication of the fuselage in view of the great number of individual rivets that are required.

FIG. 1 shows the outer part 3A of a riveting apparatus 3 according to the invention. The outer part 3A comprises a riveting machine system 8 movably arranged on a machine guide arrangement 4. The machine guide arrangement 4 is configured and arranged in a ring shape encircling the outside of the aircraft fuselage 1, representing a particular example of the general barrel-shaped structure. The "ring shape" of the machine guide arrangement 4 is not necessarily circular, but may be circular, oval or some other shape adapted to the circumferential shape of the barrel-shaped structure being fabricated. In a first embodiment, the machine guide arrangement 4 is movable in a direction parallel to the lengthwise axis or X-axis of the aircraft fuselage 1, by any known means, for example by moving along a rail system extending parallel to the lengthwise X-axis as will be described in detail below. The machine guide arrangement 4 comprises first and second ring-shaped guide rails 5 and 6 supported on an outer support arrangement (e.g. especially a movable stand 17, see FIG. 3), as well as a carriage 7 that is movably arranged on the guide rails 5 and 6. The riveting machine system 8 in turn is mounted on the movable carriage 7. The guide rails 5 and 6 extend along parallel planes that are substantially perpendicular to the lengthwise x-axis, so that the riveting machine system can move "orbitally" around the fuselage on the rails 5 and 6.

The riveting machine system 8 includes all the necessary tools and devices for producing and preparing the required rivet holes, supplying and inserting the rivet blanks into the rivet holes, and finally closing or forming the rivet connection. In this context, the riveting machine system 8 may be equipped with any known tools and devices for carrying out such a riveting operation. As an example, the tools, devices, or riveting units suitable to be provided on the riveting machine system 8 are known from German Patent 32 32 093 and corresponding U.S. Pat. No. 4,548,345 (Puritz et al.), and include a boring unit, a rivet supply unit, a rive injector, as well as rivet forming or counterholding tools for example. The disclosure of U.S. Pat. No. 4,548,345 is incorporated herein by reference.

Since the machine guide arrangement 4 is linearly movable in the X-direction via the movable stand or support frame 17 moving on the rails 26 in this first embodiment, and the carriage 7 is movable in the angular or circumferential direction along the guide rails 5 and 6, and each of the respective tools or units of the riveting machine system is movable and selectable on the carriage 7, it is possible to move the particular required tool or unit of the riveting machine system 8 to any selected rivet position on the outside of the fuselage 1 under the control or guidance of a computer control program, as will be described below. This is all carried out completely independently of the fuselage 1, which remains stationary and does not support any of the weight of the outer part 3A of the riveting apparatus. Instead, the outer part 3A is entirely supported movably on the rails 26 on the shop floor F of the assembly hall or shop in which the fuselage is being fabricated.

Figure 2:
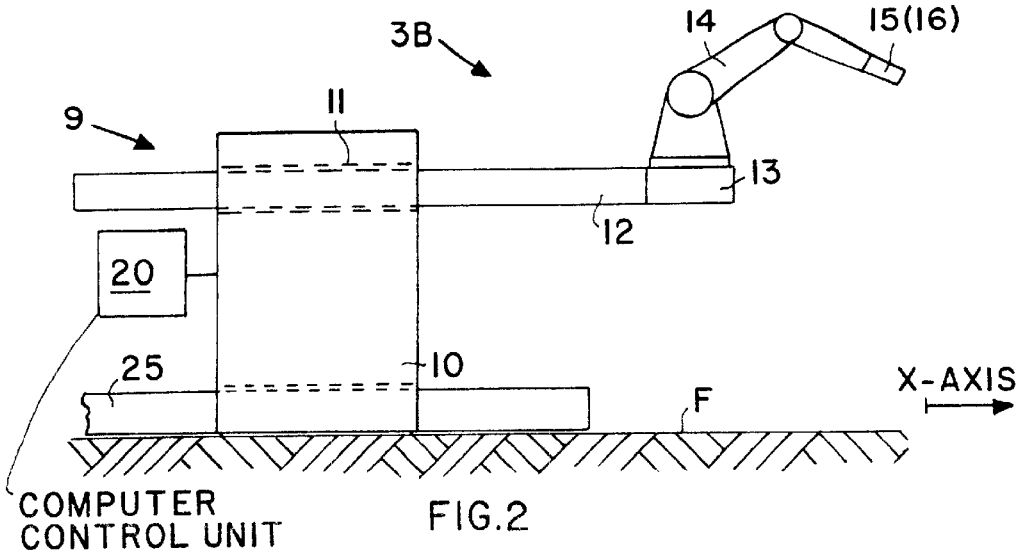
FIG. 2 is a side view of the inner part of the inventive riveting apparatus including a mounting frame and a riveting robot mounted thereon.

The riveting apparatus 3 further includes an inner part 3B, which is necessary for completing the rivet connections. Namely, the inner part 3B of the riveting apparatus 3 serves the purpose of a counterholding tool in connection with closing one-piece fasteners such as conventional rivets, and serves the purposes of supplying and setting the inner fastener piece of a multi-piece fastener, such as rivets with snap-on heads,or fastener studs with locking rings, or threaded fasteners or the like. The inner part 3B of the riveting apparatus 3 is shown in FIG. 2, and generally comprises a mounting frame 9 which is movable parallel to the lengthwise X-axis of the aircraft fuselage 1 (e.g. along a rail 25 on the floor F), and a multi-axis controlled movable riveting robot 14 mounted on this mounting frame 9. By the cooperating motion of the mounting frame 9 parallel to the lengthwise X-axis, and the multi-axis mobility of the riveting robot 14, a riveting tool head 15 mounted on the riveting robot 14 can be controllably moved to any respective working position within the aircraft fuselage 1. This also is carried out completely independently of the stationary fuselage 1, which does not support any of the weight of the inner part 3B of the riveting apparatus. Instead, the inner part 3B is entirely supported movably on the rail 25 on the shop floor F of the assembly hall or shop in which the fuselage is being fabricated.

More particularly, the mounting frame 9 of the inner part 3B of the riveting apparatus 3 can be considered as including a mounting frame on which the robot 14 is mounted, as well as an inner support arrangement that supports the mounting frame on the floor F. In the embodiment shown in FIG. 2, the mounting frame proper essentially comprises a support arm 12, while the inner support arrangement comprises a support arm stand 10 with a support arm guide 11. The support arm 12 is movably supported in the support arm guide 11 so as to be movable parallel to the lengthwise X-axis of the aircraft fuselage 1. The support arm stand 10 in turn is carried on and movable along a guide rail 25, e.g. arranged on the shop floor F, outside of the aircraft fuselage 1. Thus, it can be seen in FIG. 2 that the inner part 3B is supported on the shop floor F and not on the fuselage 1. Moreover, the support arm 12, or at least the free end 13 of the support arm 12, is also rotatable about an axis parallel to the lengthwise X-axis of the aircraft fuselage 1. The above mentioned riveting robot 14 is mounted on the free end 13 of the support arm 12. Various configurations and arrangements of multi-axis robots, as well as movable support arrangements for carrying the multi-axis robot, are known in the art and any such arrangement can be used in the riveting apparatus according to the invention, as long as the necessary degrees of mobility are achieved.

In the present illustrated embodiment, the riveting robot 14 comprises a plurality of articulately joined arm segments or elements, and the above mentioned riveting tool head 15 is mounted on the end-most arm segment or free end of the riveting robot 14. The tool head 15 carries the respective necessary tool or the respective tool unit as needed for the particular application, i.e. depending on the type of rivet or rivet-like fastener that is being used. Throughout this specification, the term rivet is intended to cover one-piece rivets of which a tail end is deformed to form the closing head, as well as two-piece rivets and rivet-like fasteners that include a fastener stud and a securing head, clip, pin, ring or nut that fastens the tail end of the fastener stud. In this context, the tool head 15 can be equipped with a recoil-damped counterholding tool which applies the necessary counterholding force for forming the closed rivet connection when using one-piece fasteners such as conventional rivets, or the tool head 15 can be equipped with a closing head tool that supplies an then sets a closing or fastening ring onto the end of a fastening stud when using two-piece fasteners, as is known from German Patent 37 15 927 and corresponding U.S. Pat. No. 4,854,491.

The riveting apparatus 3 further includes or cooperates with a computerized control unit 20 that provides desired position data to the outer part 3A and the inner part 3B of the riveting apparatus 3, and preferably also receives actual position data from the outer part 3A and the inner part 3B of the riveting apparatus 3. The generation, representation and provision of the control data and monitoring data can be carried out in any manner known in the art for controlling and monitoring the operation of robotic or automatic machines. For example, the coordinates of required rivet locations as well as an optimized motion sequence for moving the tool head 15 of the inner part 3B of the riveting apparatus 3 as well as the riveting machine system 8 of the outer part 3A of the riveting apparatus 3 successively to a sequence of riveting locations an be stored in a computer memory and then read out to the riveting apparatus 3 for carrying out the riveting operation. Specific movement commands can also be input into the computer control unit 20 by an operator.

In accordance with the control data received from the control unit 20, the support arm 12 and the riveting robot 14 supported thereon are cooperatively moved to each respective required riveting location on the workpiece or fuselage 1, while moving around any obstacles such as stringers, frames, webs, studs, spars, struts, floors and the like that typically exist in the aircraft fuselage 1. The locations and configurations of all of these obstacles as well as the required riveting locations at which the tool head 5 must be positioned, can all be pre-programmed in the control unit 20, for example based on the computer aided drafting (CAD) plans or blueprints of the fuselage structure.

Figure 3:
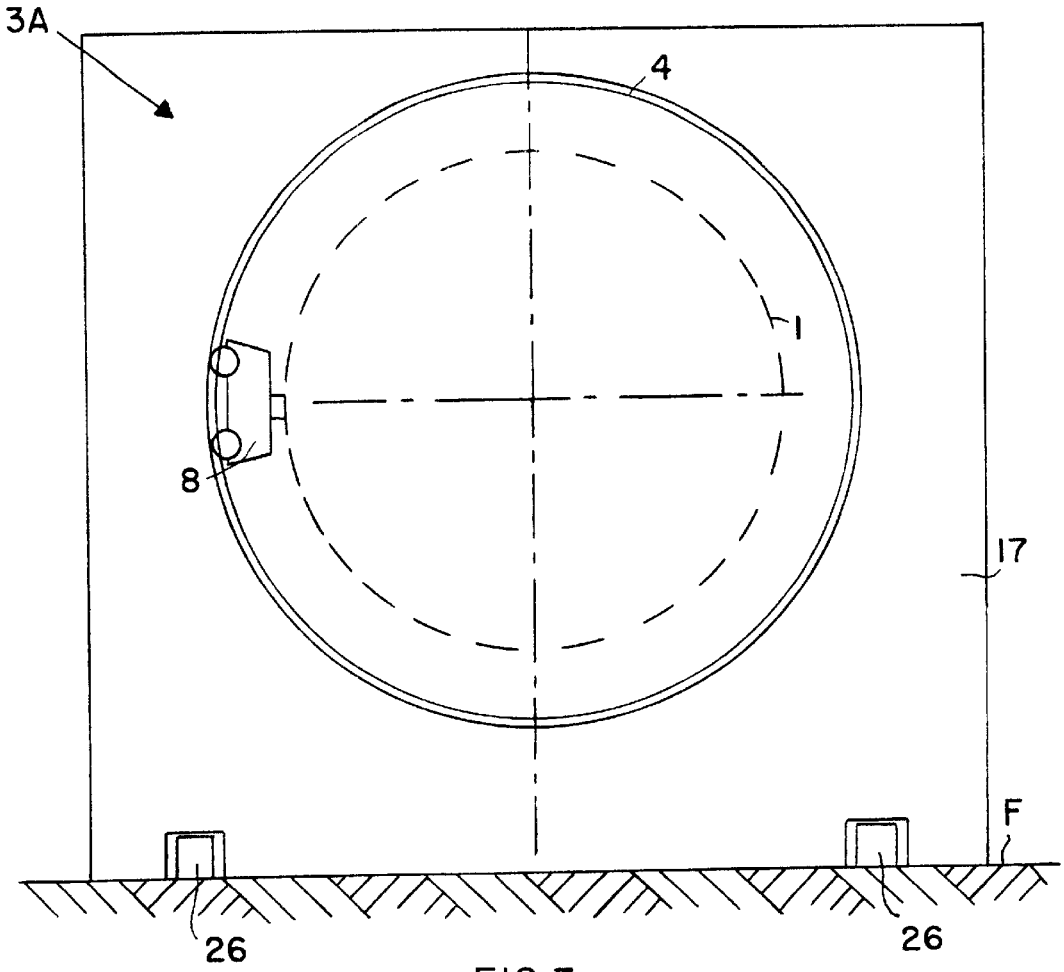
FIG. 3 is a front or end view of the outer part of the riveting apparatus according to the invention.

FIG. 3 schematically hows a front view or end view of the outer part 3A of the riveting apparatus 3, which is also known as an orbital riveting system, arranged externally encircling or surrounding the fuselage 1 or other barrel-shaped workpiece. As described above, the riveting machine system 8 of the outer part 3A of the riveting apparatus 3 can be driven along the annular machine guide arrangement 4 that encircles the aircraft fuselage 1 in a ring-shape while the guide arrangement can be moved along the X-direction, in order that the riveting machine system 8 can be moved precisely to each required rivet location in succession, in coordination with the tool head 15 of the inner part 3B of the riveting apparatus 3. In this manner, the rivets along both a transverse or circumferential joint 2A as well as respective segments of longitudinal joints 2B of the aircraft fuselage can be secured during the fabrication process of the aircraft fuselage 1.

In order to allow the riveting machine system 8 to move in a direction parallel to the lengthwise X-axis and thereby move along a longitudinal joint 2B to be riveted, the annular machine guide arrangement 4 is mounted on a movable support stand or frame 17, which is movable in the X-direction, e.g. being movably supported on a rail system 26 on the shop floor F, and thereby moves the orbital riveting system in the X-direction. This movable stand or frame 17 is merely schematically represented in FIG. 3, and has been omitted from FIG. 1 for the sake of improved clarity and simplicity of the illustration. In FIG. 3 it can be seen that the outer part 3A is supported on the shop floor F, and is not supported on and does not contact the fuselage 1. The motion of the frame 17 in the X-direction is numerically or computer controlled by the controller 20, just as the other machine motions described above.

Both the outer part A and the inner part 3B of the riveting apparatus 3 can be connected to the same computer control unit 20 as described above, or to two respective control units 20 which are coordinated with each other. In this manner it is ensured that the working locations of the outer part 3A and the inner part 3B are coordinated, i.e. both parts are moved to the same respective rivet location at the same time. Thereby, the operation of the two parts of the riveting apparatus 3 is coordinated by the one or more control units 20 in such a manner that the controlled movement and positioning of the respective inner and outer riveting tools to the respective rivet location and then the sequence of working steps for producing the rivet connection are adapted and coordinated with one another, both in time and in space, and also optimized with respect to the particular workpiece and riveting requirements of any given application.

Thus, a fully automatic assembly of the aircraft fuselage 1 can be realized. To achieve this, in particular, the outer orbital riveting system including the riveting machine system 8 moving around the machine guide arrangement 4 and moving along the X-direction with the movable stand 17 works around the outside of the aircraft fuselage 1, while the riveting robot 14 on the mounting frame 9 carries out the necessary working steps from the inside of the fuselage 1. The external riveting machine system 8 first bores a rivet hole at the required rivet location using a boring unit, then applies a sealant to the bore hole using a sealant supply unit, then retrieves and supplies a rivet or the like from a rivet supply container, and inserts the rivet into the rivet hole by means of a rivet feed unit. All of the steps are carried out under computer control. Meanwhile, the riveting robot 14 clampingly holds the workpieces, i.e. the two parts 1A and 1B of the fuselage 1 during the boring process, and then closes or secures the inner end of the rivet after it has been inserted into the bored hole. Specifically, the riveting robot 14 can apply a counter force with a counterholding tool, or can deform the tail end of the rivet to form the closing head of a one-piece rivet, or alternatively places the locking ring onto the end of the inserted rivet stud and thereafter deforms and fastens the locking ring, in the case of a two-part fastener.

These steps are also carried out under computer control. After the rivet has been completed, both the outer part 3A and the inner part 3B of the riveting apparatus 3 are moved to the next pre-programmed rivet location, and the sequence of steps necessary for producing the rivet connection at the new rivet location are automatically repeated.

Two different embodiments or variants of the inventive apparatus, as well as two different embodiments of a riveting method carried out by the apparatus, will now be described in connection with FIGS. 4 to 9.

Figure 4:
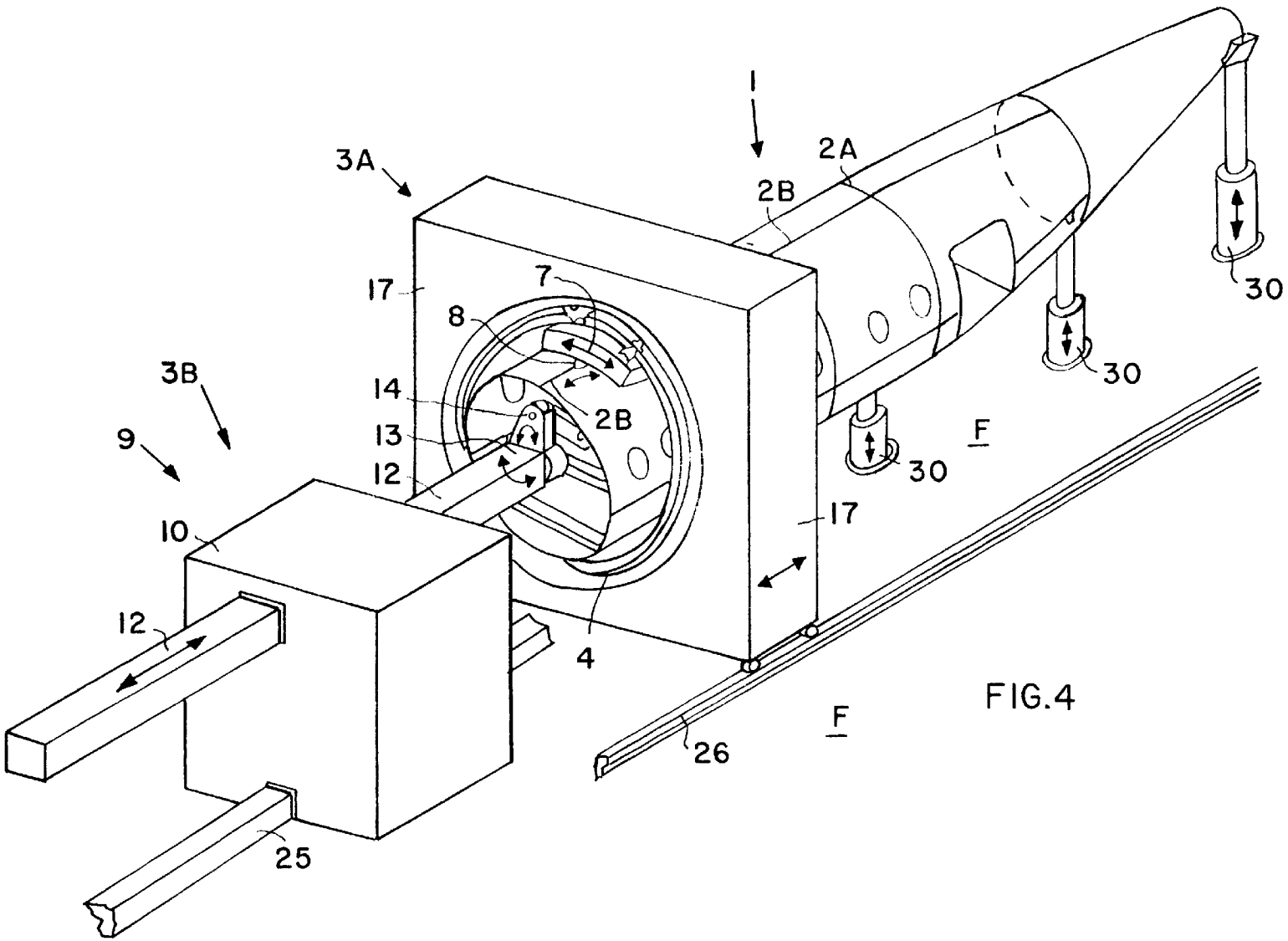
FIG. 4 is a schematic perspective view of a first embodiment of the riveting system in which the aircraft fuselage being assembled remains stationary, while the outer riveting apparatus and the inner riveting apparatus are moveable.

FIG. 4 is a schematic perspective view of a first embodiment of the inventive riveting apparatus, which has already been described above. FIG. 4 shows the outer apparatus part 3A and the inner apparatus part B respectively arranged moveably on rails 26 and 25 in the longitudinal X-direction on the shop floor F as described above. The reference numbers used in FIG. 4 correspond to those in FIGS. 1 to 3, and a redundant description of the respective components will not be provided here. While FIG. 4 shows the support arm stand 10 of the inner apparatus part 3B moveably mounted on a rail 25, it is alternatively possible to have the stand 10 being stationary on the floor F, as long as the support arm 12 has a sufficient sliding range in the X-direction to carry out the complete assembly procedure.

In this first embodiment of FIG. 4, the fuselage 1 being assembled remains stationary, and is supported on adjustable supports 30, which also serve to adjust the vertical position, orientation, and alignment of the fuselage 1 relative to new fuselage sections being joined to it, and relative to the riveting apparatus. These adjustable supports 30 may, for example, be mechanically adjustable jack stands, or hydraulically or electro-mechanically adjustable jacks, or the like. The respective adjustment of each adjustable support 30 is controlled independently by the computer controller 20 or other numerical control means.

Since the fuselage 1 remains stationary relative to the floor F, of as the outer apparatus part 3A and preferably also the inner apparatus part 3B is moveable in the X-direction, the fuselage 1, as it is being assembled, "grows" along the X-direction generally toward the lower left of FIG. 4. In the state shown in FIG. 4, several sections of the fuselage 1 have already been assembled by joining respective shell components along transverse or circumferential joints 2A and longitudinal joints 2B. FIG. 4 shows the outer apparatus part 3A moving along the rail 26 in the X-direction so that the outer riveting tool can set rivets along the longitudinal joint 2B, while the inner riveting tool on the riveting robot 14 moves correspondingly by a motion of the robot 14, and/or a sliding action of the support arm 12 relative to the support arm stand 10, and/or by a motion of the stand 10 along the rail 25.

Figure 5:
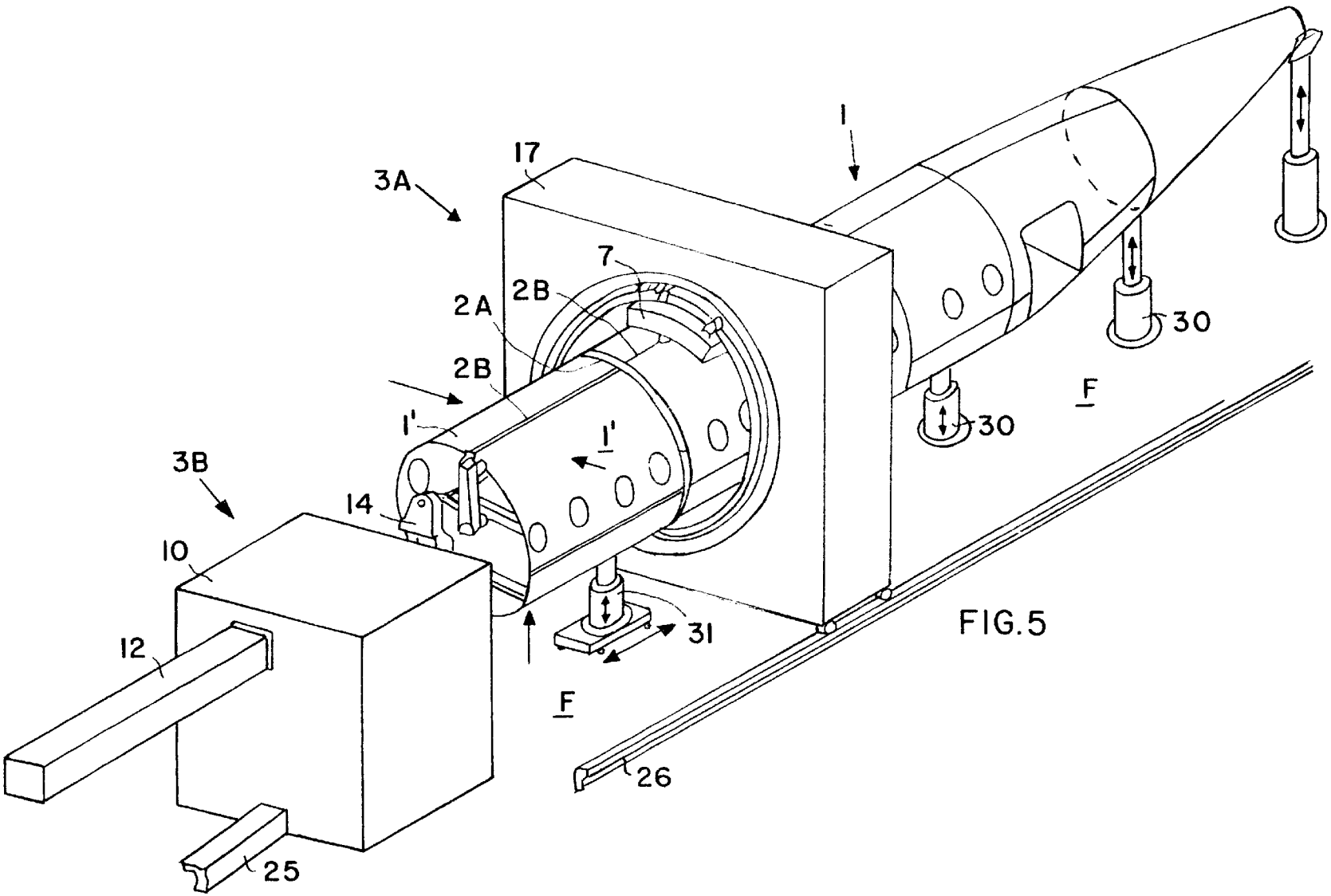
FIG. 5 is a schematic view of the apparatus according to the second embodiment, in a later stage of assembling the fuselage, in comparison to FIG. 4.

FIG. 5 shows a next sccessive stage in the fabrication procedure. The fuselage 1 has remained stationary and supported on the adjustable supports 30. The support arm stand 10 of the inner apparatus part 3B has moved further toward the left along the rail 25, to make room for the next fuselage section to be added on to the fuselage 1. The separate fuselage shell components 1' have been moved into position by any conventional means, for example by overhead lifting cables, by rolling dollies, or by lift trucks or the like. The shell components 1' are then tacked and held together in a lateral and/or circumferential direction, while being supported on a moveable adjustable support 31, which may be a hydraulic jack or a mechanically adjustable jack, or the like, on a rolling trolley that is moveable in the X-direction as well as perpendicularly thereto. This adjustable support 31 adjusts the new fuselage section in its height and orientation to properly adjoin the existing part of the assembled fuselage 1 along a new circumferential joint 2A.

Once the riveting tools finish riveting the longitudinal joint 2B of the prior fuselage section, the outer apparatus part 3A and the inner apparatus part 3B move into the proper position along the X-direction to rivet the new transverse or circumferential joint 2A. Once that circumferential joint 2A has been completely riveted, then the riveting apparatus move further in the X-direction to rivet the longitudinal joints 2B of the new fuselage section. In order to allow the outer apparatus part 3A to move in the X-direction in this manner, the adjustable support or stand 31 must first be moved out of the way, but this presents no problems once the circumferential joint 2A has been riveted, and especially after the longitudinal joints 2B have been riveted along at least a portion of their length, because then the new fuselage section will be adequately supported by the previously assembled fuselage portion 1.

In the above manner, successive fuselage sections are riveted onto the previously assembled existing fuselage 1, while the fuselage 1 remains stationary and "grows" toward the left in the X-direction, and the outer apparatus part 3A and the inner apparatus part 3B correspondingly move toward the left in the X-direction to successive assembly stations at which each respective successive fuselage section is joined to the existing fuselage and assembled.

FIGS. 6 to 9 show a second embodiment in which the outer apparatus part 3A remains stationary on the floor F, the stand 10 of the inner apparatus part 3B may either remain stationary on the floor F or may be movable over a limited range in the X-direction, and the fuselage 1 being assembled is moved under a numeric control as necessary in the X-direction to carry out the riveting procedure. Once again, the same reference numbers are used for the same components as in the preceding figures, and a redundant description of these components will not be provided here. Instead, the present discussion will focus on the special additional components shown in FIGS. 6 to 9, as well as the process steps being carried out in this second embodiment.

The fuselage 1 being assembled is supported on moveable carriages or pallets 40 that are moveable in the X-direction along one or more rails 41. This rail 41 may comprise a rail member protruding above the shop floor F, or could be a guide groove set down into the shop floor F, and may be provided with teeth to form a linear gear rail or rack along which a gear wheel or cog of the moveable pallets 40 may be engagingly driven, or may include a rotatable threaded spindle on which drive nuts of the pallets 40 are engaged. This rail 41 preferably also includes sensors of a location or a path distance measuring system, so that the exact position of each carriage or pallet 40 is known by the computer controller 20. Each pallet 40 is equipped with height-adjustable support stands 42, which may for example be mechanically, electro-mechanically, or hydraulically adjusted in height relative to the pallet 40, so as to stably support the fuselage 1, and also adjust the height, orientation, and position of the fuselage 1 relative to the new fuselage section being joined thereto, and relative to the riveting apparatus.

Figure 6:
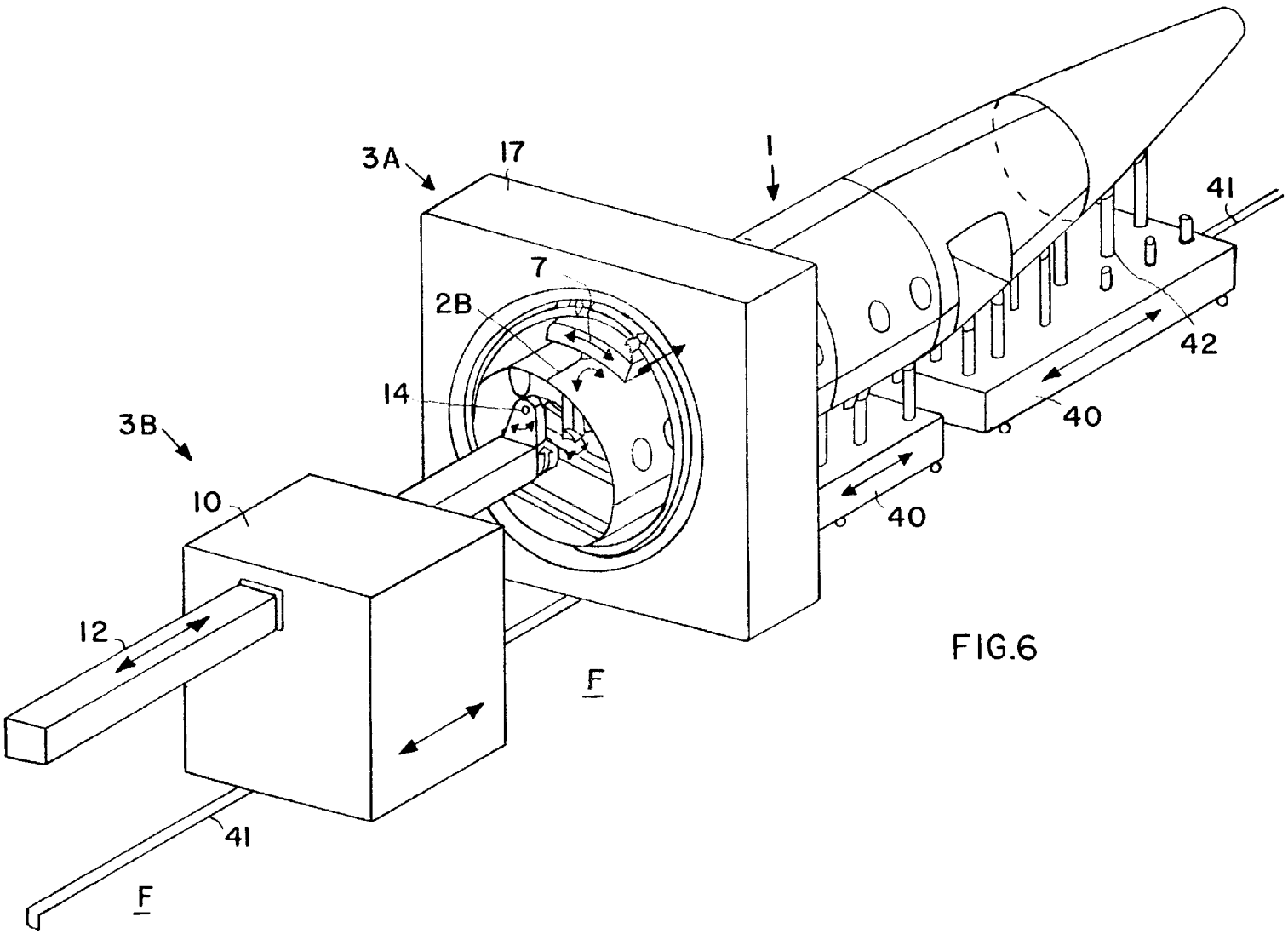
FIG. 6 is a schematic perspective view of a riveting system according to a second embodiment of the invention, in which the fuselage being assembled is moveable during the riveting process, while the outer riveting apparatus remains stationary and the inner riveting apparatus is either stationary or moveable relative to the assembly hall floor.

In the stage of the process shown in FIG. 6, the outer apparatus part 3A is riveting the longitudinal joint 2B along the top of the most recently added fuselage section. Since the outer apparatus part 3A remains stationary relative to the floor F, to achieve this longitudinal riveting, the entire assembled fuselage 1 is moved toward the right along the X-direction by appropriately moving the pallets 40 along the rail 41 under a numerical control, for example provided by the computer controller 20. Since the fuselage 1 itself undergoes the necessary longitudinal movement, both the outer riveting tool and the inner riveting tool can remain longitudinally stationary, while the longitudinal joint 2B moves along the riveting tools.

Figure 7:
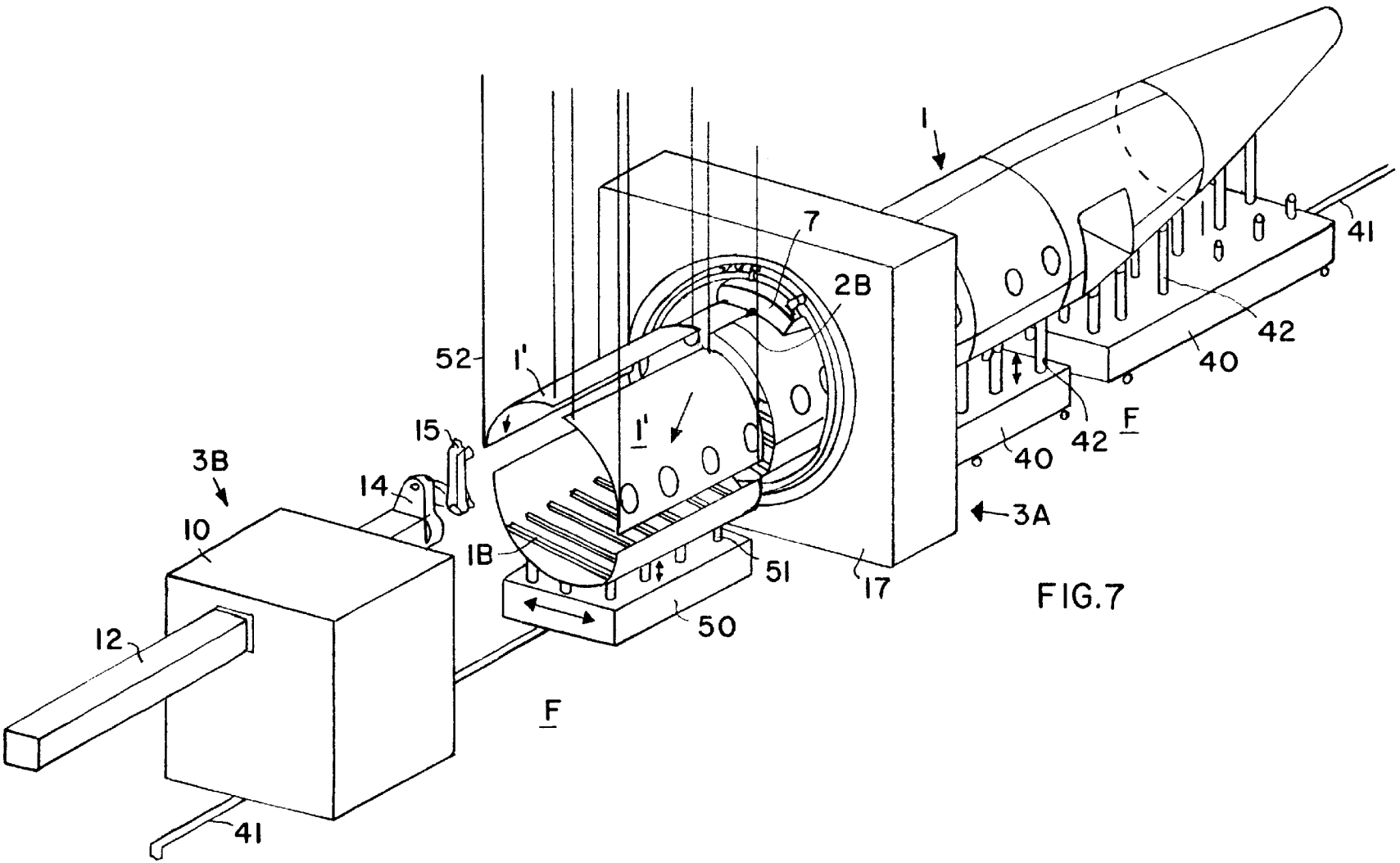
FIG. 7 is a schematic perspective view of the apparatus according to FIG. 6, but showing a next successive stage of the assembly procedure.

FIG. 7 shows the shell components 1' being moved into position, for example on lift cables 52, at an assembly station having a fixed location adjacent to the fixed outer apparatus part 3A. It can also be seen that an aircraft cabin floor 1B, or at least the supporting members of the floor 1B have been pre-installed in the fuselage belly shell. This belly pan or shell is supported on a moveable carriage or pallet 50, via height-adjustable supports or stands 51. This pallet 50 is moveable along the X-direction and perpendicular thereto, to bring the fuselage belly shell into the assembly station, and the supports 51 are adjustable in the vertical direction to properly support the fuselage belly shell and to bring it into the proper height, position, orientation, and alignment to be joined onto the previously assembled fuselage 1. At this point, the several fuselage shell components will be held and/or tacked together and properly adjoined or overlapped with the previously assembled fuselage 1 to form a new transverse or circumferential joint 2A.

To provide the necessary space away from the outer apparatus part 3A for receiving the new fuselage section shell components in the assembly station, the inner apparatus part 3B, and particularly the stand 10 thereof, is either positioned stationarily at a sufficient distance on the floor F away from the outer apparatus part 3A, or is moved back away from the outer apparatus part 3A along, the X-direction to receive the next fuselage section in the assembly station.

Figure 8:
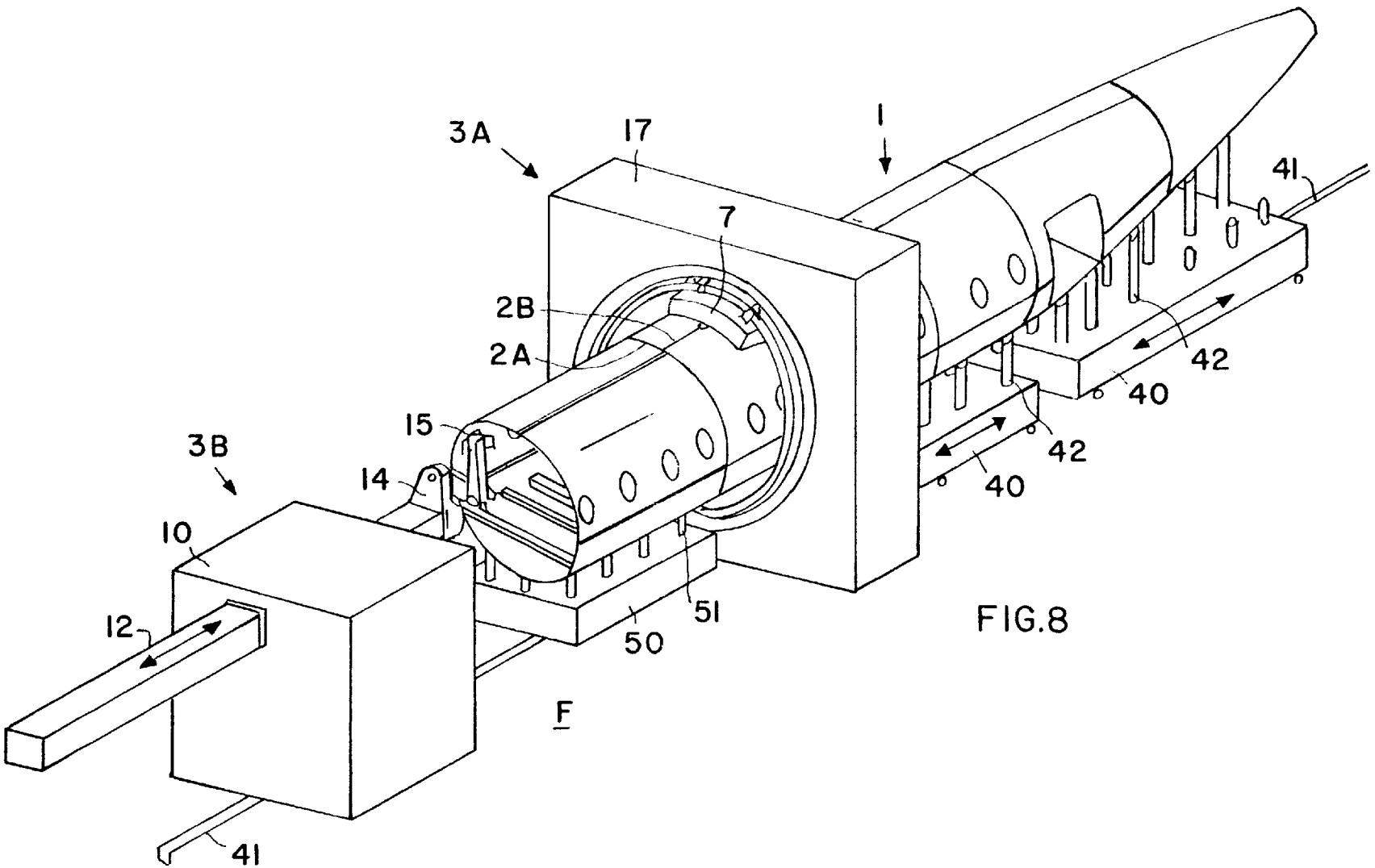
FIG. 8 is a schematic perspective view showing a next successive stage after FIG. 7.

FIG. 8 shows the next step in which the new fuselage section shell components have been held or tacked together, and the moveable pallet 50 has been moved along the X-direction to bring the new fuselage section into position adjoining the previously assembled fuselage 1 along a new transverse joint 2A. In FIG. 8, the fuselage 1 is still being moved longitudinally toward the right on the carriages or pallets 40, and the new fuselage section is being moved simultaneously therewith toward the right on the pallet or carriage 50, so that the riveting apparatus can complete the riveting of the longitudinal joint or joints 2B of the prior fuselage section.

Figure 9:
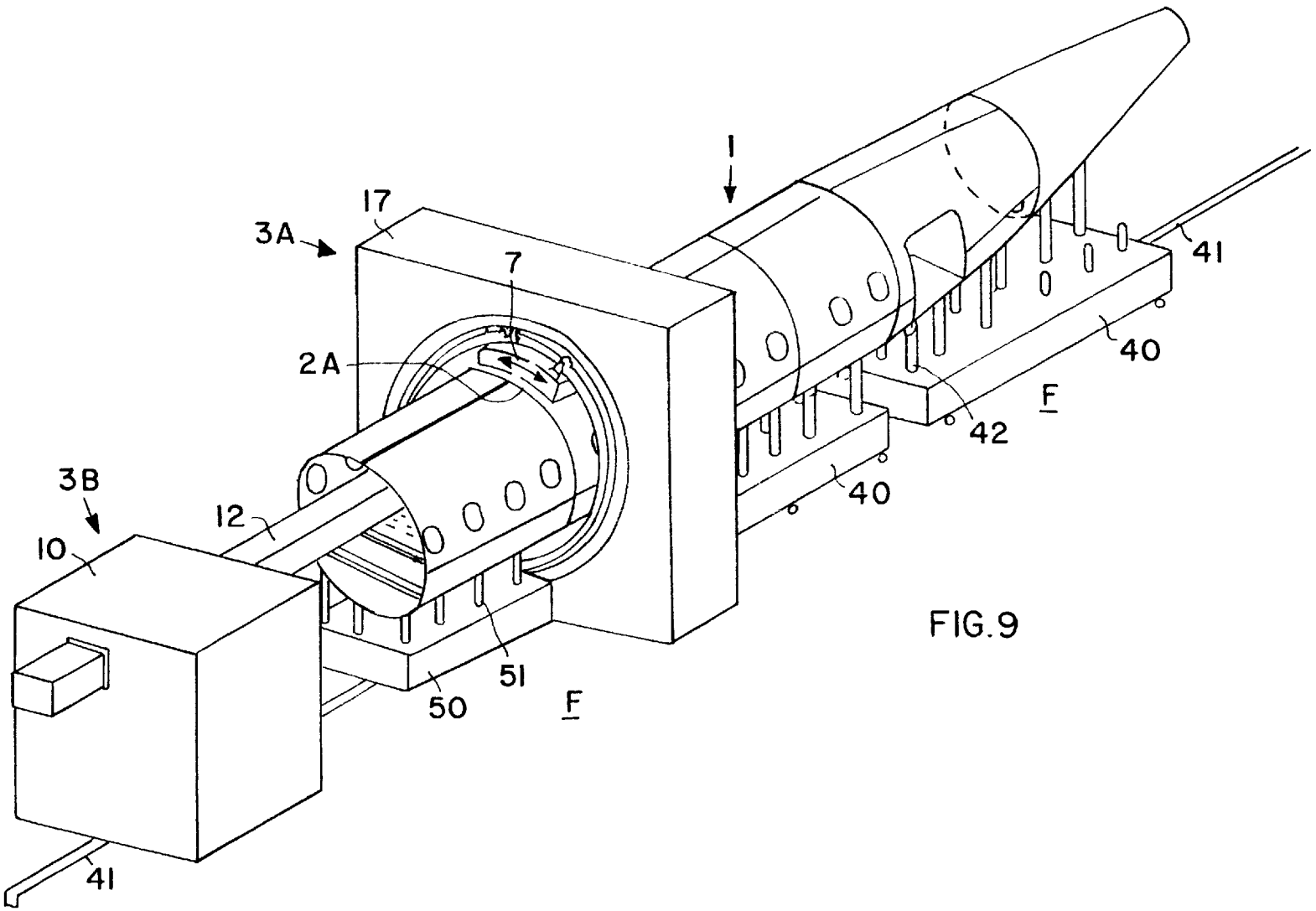
FIG. 9 is a schematic perspective view showing a next successive stage after FIG. 8.

Then, as shown in FIG. 9, once the riveting equipment finishes riveting the prior longitudinal joints 2B, the X-direction motion of the fuselage 1 is stopped, with the new circumferential joint 2A aligned precisely on the working plane of the outer apparatus part 3A, so that the outer and inner riveting tools can now move circumferentially to rivet the new section onto the fuselage 1 along the new circumferential joint 2A. Once that is completed, the fuselage 1 will again be moved longitudinally toward the right, while the riveting apparatus will rivet the longitudinal joints 2B of the new section. The pallet or carriage 50 must of course stop its longitudinal motion toward the right once it reaches (or just before) the stationary outer apparatus part 3A. At this point, the new fuselage section has been at least tack-riveted or already completely rive ted to the previously assembled fuselage 1 along the circumferential joint 2A, so that the carriages or pallets 40 moving the fuselage 1 longitudinally toward the right will pull the entire fuselage including the new section through the stationary outer apparatus part 3A, while the belly shell component of the new fuselage section slides or glides along the now-stationary adjustable support stands 51, so as to carry out the longitudinal riveting along the longitudinal joints 2B of the new section.

The above described steps are repeated successively for each successive new fuselage section at the same assembly station adjacent to the stationary outer apparatus part 3A, while the fuselage 1 is successively pulled toward the right, until the entire fuselage 1 has been completed.

While the above disclosure has described the invention in relation to the assembly of an aircraft fuselage, it should be understood that the manufactured product including a barrel-shaped structure could alternatively be any other type of such structure having a barrel shape, such as a submarine, a railroad train car, a tunnel casing, a pipeline, a rocket, or the like.

Although the invention has been described with reference to specific example embodiments, it will be appreciated that it is intended to cover all modifications and equivalents within the scope of the appended claims. It should also be understood that the present disclosure includes all possible combinations of any individual features recited in any of the appended claims.

What is claimed is:

1. A joining apparatus for joining together large format surface area workpieces along longitudinal joints extending parallel to an X-axis and orbital joints extending orbitally around said X-axis to form a manufactured product including a barrel-shaped structure, said apparatus comprising:

i) an outer apparatus part comprising an outer support arrangement, a ring-shaped machine guide arrangement, and a joining machine system;

wherein said outer support arrangement is supported on an assembly area floor independent of the manufactured product, and at least said outer support arrangement or the manufactured product is supported movably relative to each other to enable relative motion therebetween in a longitudinal direction parallel to said X-axis;

wherein said ring-shaped machine guide arrangement is supported by said outer support arrangement independently of and without being supported on the manufactured product, and is dimensioned, configured and adapted to extend around an outer perimeter of the barrel-shaped structure in an orbital direction; and wherein said joining machine system includes at least a first joining tool and is movably arranged on said machine guide arrangement so as to be movable therealong in said orbital direction, wherein said first joining tool can be moved selectively and sequentially to plural joint locations on the outer perimeter of the barrel-shaped structure by moving said joining machine system along said machine guide arrangement in said orbital direction and moving at least one of said outer support arrangement and the manufactured product relative to each other in said longitudinal direction parallel to said X-axis;

ii ) an inner apparatus part comprising an inner support arrangement, a mounting frame, a multi-axis movable robot, and a tool head;

wherein said inter support arrangement is supported on said assembly area floor independent of the manufactured product;

wherein said mounting frame is supported by said inner support arrangement independently of and without being supported on the manufactured product, and is movable in said longitudinal direction parallel to said X-axis on said inner support arrangement;

wherein said multi-axis movable robot is mounted on and supported by said mounting frame and adapted to be moved into a space within the barrel-shaped structure; and wherein said tool head includes at least one second joining tool mounted on and supported by said robot, wherein said second joining tool can be moved selectively and sequentially to said plural joint locations on an internal surface of the barrel-shaped structure by moving said mounting frame in said longitudinal direction parallel to said X-axis and by moving said robot to move said tool head at least in said orbital direction relative to said mounting frame; and iii) at least one control unit respectively including a computer, which is connected to said inner apparatus part and to said outer apparatus part, and adapted to provide to said inner apparatus part and to said outer apparatus part control signals generated by said computer to control and coordinate moving of said inner apparatus part and said outer apparatus part sequentially to said plural joint locations and to control and coordinate operating steps of said first and second joining tools to form joint connections at said joint locations.

2. The joining apparatus according to claim 1, wherein said joining machine system is a riveting machine system, said at least one first joining tool is at least one first riveting tool, said at least one second joining tool is at least one second riveting tool, said joint locations are rivet locations and said joint connections are rivet connections.

3. The joining apparatus according to claim 2, wherein said at least one first riveting tool includes all tools necessary for boring a rivet hole, supplying and inserting a rivet blank into the rivet hole, and carrying out a rivet fastening of the rivet blank at a respective one of said rivet locations.

4. The joining apparatus according to claim 2, wherein said at least one second riveting tool comprises a counter-holding tool.

5. The joining apparatus according to claim 2, wherein said at least one second riveting tool comprises a rivet head closing tool.

6. The joining apparatus according to claim 1, wherein said at least one control unit comprises two control units respectively including two of said computers, said two control units are connected to each other, a first one of said two control units is connected to said outer apparatus part, and a second one of said two control units is connected to said inner apparatus part.

7. The joining apparatus according to claim 1, wherein said inner support arrangement of said inner apparatus part comprises a support arm stand having a support arm guide, and said mounting frame of said inner apparatus part comprises a support arm that extends horizontally in said longitudinal direction and that is horizontally movably supported by said support arm guide so as to be movable linearly in said longitudinal direction parallel to said X-axis in said support arm guide, and wherein said robot is mounted on a free end of said support arm.

8. The joining apparatus according to claim 7, wherein said support arm is rotatable in said orbital direction about said X-axis in said support arm guide.

9. The joining apparatus according to claim 7, wherein said support arm comprises a main arm segment and an end arm segment that includes said free end of said support arm and that is rotatably connected to said main arm segment so as to be rotatable in said orbital direction about said X-axis.

10. The joining apparatus according to claim 1, wherein said assembly area floor comprises a supporting floor and a guide rail extending in said longitudinal direction parallel to said X-direction and mounted on or in said supporting floor, and said inner support arrangement comprises a movable support stand that is movably mounted on said guide rail so as to be movable therealong in said longitudinal direction parallel to said X-axis.

11. The joining apparatus according to claim 1, wherein said inner support arrangement comprises a stationary support stand that is stationarily supported on said assembly area floor.

12. The joining apparatus according to claim 1, wherein said assembly area floor comprises a supporting, floor and a rail system extending parallel to said X-axis and mounted on or in said supporting floor, and said outer support arrangement comprises a movable support frame that carries said ring-shaped machine guide arrangement and that is movably arranged on said rail system to be movable therealong in said longitudinal direction parallel to said X-axis.

13. The joining apparatus according to claim 12, wherein said rail system, said ring-shaped machine guide arrangement and said movable support frame do not contact the manufactured product.

14. The joining apparatus according to claim 1, wherein said outer support arrangement comprises a stationary support frame that is stationarily supported on said assembly area floor.

15. The joining apparatus according to claim 1, further comprising stationary support stands that each have an adjustable height, are respectively stationarily arranged on said assembly area floor, and are adapted to adjustably support the manufactured product.

16. The joining apparatus according to claim 1, further comprising a mobile pallet arrangement including a mobile pallet movably arranged on said assembly area floor, and adjustable supports that each have an adjustable height, that are arranged on said pallet, and that are adapted to adjustably support the manufactured product.

17. The joining apparatus according to claim 1, wherein said X-axis is perpendicular to a plane along which said ring-shaped machine guide arrangement extends, and said orbital direction extends along said plane.

18. The joining apparatus according to claim 1, wherein said machine guide arrangement has a circular shape adapted to entirely encircle the perimeter of the barrel-shaped structure.

19. The joining apparatus according to claim 1, wherein said machine guide arrangement has an oval shape adapted to extend entirely around the perimeter of the barrel-shaped structure.

20. A riveting apparatus for riveting together large format surface area workpieces along longitudinal joints extending parallel to an X-axis and orbital joints extending orbitally around said X-axis, to form a manufactured product including a barrel-shaped structure, said apparatus comprising:

an outer riveting tool located outside of the barrel-shaped structure;

outer tool support means for supporting said outer riveting tool on an assembly area floor and for moving said outer riveting tool in an orbital direction extending orbitally around said X-axis, without supporting said outer riveting tool and said outer tool support means on the manufactured product;

product support means for adjustably supporting the manufactured product relative to said assembly area floor;

relative movement means for moving at least one of said outer tool support means and said product support means relative to each other and relative to said assembly area floor;

an inner riveting tool located inside of the barrel-shaped structure; and inner tool support means for supporting said inner riveting tool on said assembly area floor, for reaching said inner riveting tool into the barrel-shaped structure and for moving said inner riveting tool in a longitudinal direction parallel to said X-axis and in an orbital direction extending orbitally around said X-axis, without supporting said inner riveting tool and said inner tool support means on the manufactured product.

21. The riveting apparatus according to claim 20, wherein said relative movement means comprise movable pallets that are movably arranged on said assembly area floor and that carry said product support means.

22. The riveting apparatus according to claim 20, wherein said relative movement means comprise at least one rail on said assembly area floor, along which said outer tool support means is movably arranged.

23. A method of using said riveting apparatus according to claim 20 for joining together shell components as said large format surface area workpieces to fabricate an aircraft fuselage as said manufactured product, comprising the following steps:

a) providing a fabricated portion of an aircraft fuselage and supporting said fabricated portion on an assembly area floor using said product support means;

b) supporting said outer riveting tool relative to said assembly area floor using said outer tool support means, and supporting said inner riveting tool relative to said assembly area floor using said inner tool support means;

c) positioning at least two fuselage section shells to adjoin and align with an end of said fabricated portion along a transverse joint therebetween;

d) moving said outer and inner riveting tools orbitally around said fabricated portion, while using said outer and inner riveting tools to rivet said fuselage section shells to said end of said fabricated portion along said transverse joint therebetween;

e) after said step d), moving at least one of said fabricated portion and said outer and inner riveting tools relative to each other, so as to relatively move said outer and inner riveting tools in a longitudinal direction along a respective longitudinal joint between said at least two fuselage section shells, while using said outer and inner riveting tools to rivet said at least two fuselage section shells to each other along said longitudinal joint;

wherein a result of said steps d) and e) is that said at least two fuselage section shells become a further part of said fabricated portion.

24. The method according to claim 23, further comprising successively repeating successive cycles of said steps c), d) and e).

25. The method according to claim 23, wherein said step e) comprises moving said fabricated portion in said longitudinal direction relative to said assembly area floor and relative to said outer and inner riveting tools.

26. The method according to claim 23, wherein said step e) comprises moving said outer and inner riveting tools in said longitudinal direction relative to said assembly area floor and relative to said fabricated portion.

27. The method according to claim 23, wherein all of said steps are carried out while supporting said outer and inner riveting tools relative to said assembly area floor and entirely independently of said fabricated portion.

* * * * *

UNITED STATES PATENT AND TRADEMARK OFFICE

CERTIFICATE OF CORRECTION

PATENT NO. : 6,505,393 B2 
DATED : January 14, 2003
INVENTOR(S) : Stoewer et al.

It is certified that error appears in the above-identified patent and that said Letters Patent is hereby corrected as shown below:

Title page,
Item [57], ABSTRACT,
Line 7, after "a", replace "length-wise" by -- lengthwise --.

Column 7,
Line 9, before "injector,", replace "rive" by -- rivet --;
Line 37, after "snap-on", replace "heads,or" by -- heads, or --.

Column 8,
Line 66, after "schematically", replace "hows" by -- shows --.

Column 9,
Line 32, before "and", replace "A" by -- 3A --.

Column 10,
Line 19, after "part", replace "B" by -- 3B --;
Line 58, after "next", replace "sccessive" by -- successive --.

Column 12,
Line 36, after "along" delete ",";
Line 64, after "completely", replace "rive ted" by -- riveted --.

Column 13,
Line 63, after "said", replace "inter" by -- inner --;

Column 15,
Line 17, after "supporting", delete ",".

Signed and Sealed this

Twenty-fifth Day of March, 2003

JAMES E. ROGAN
*Director of the United States Patent and Trademark Office*